US008109338B2

(12) United States Patent
Belik

(10) Patent No.: US 8,109,338 B2
(45) Date of Patent: Feb. 7, 2012

(54) PIPE SECTION GUIDE SYSTEM WITH FLEXIBLE MEMBER

(75) Inventor: Jaroslav Belik, Pearland, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 13/121,648

(22) PCT Filed: Sep. 30, 2009

(86) PCT No.: PCT/US2009/058995

§ 371 (c)(1),
(2), (4) Date: Mar. 29, 2011

(87) PCT Pub. No.: WO2010/039811

PCT Pub. Date: Apr. 8, 2010

(65) Prior Publication Data

US 2011/0174502 A1 Jul. 21, 2011

(51) Int. Cl.
*E21B 19/16* (2006.01)

(52) U.S. Cl. ..... 166/380; 414/22.58; 414/22.68

(58) Field of Classification Search ..... 166/380; 175/85; 414/22.51, 22.57, 22.58, 22.68, 414/744.1

See application file for complete search history.

(56) References Cited

U.S. PATENT DOCUMENTS

| | | | | |
|---|---|---|---|---|
| 2,692,059 | A * | 10/1954 | Bolling, Jr. | 414/22.51 |
| 2,730,246 | A * | 1/1956 | Stone | 414/22.71 |
| 2,828,024 | A * | 3/1958 | True | 414/22.51 |
| 2,958,435 | A * | 11/1960 | Schmidgall | 414/620 |
| 3,533,516 | A * | 10/1970 | Guier | 414/22.51 |
| 4,269,554 | A | 5/1981 | Jackson | |
| 4,440,536 | A * | 4/1984 | Scaggs | 414/22.51 |
| 4,643,624 | A * | 2/1987 | Murphree | 414/22.61 |
| 2006/0243488 | A1 | 11/2006 | Pietras | |
| 2007/0017703 | A1 | 1/2007 | Belik | |
| 2007/0017704 | A1 | 1/2007 | Belik | |
| 2007/0031215 | A1 | 2/2007 | Belik | |
| 2007/0074460 | A1 | 4/2007 | Belik | |
| 2008/0101891 | A1 | 5/2008 | Belik | |
| 2008/0164064 | A1 | 7/2008 | Belik et al. | |

FOREIGN PATENT DOCUMENTS

| | | | |
|---|---|---|---|
| EP | 1748149 | B2 | 1/2007 |
| WO | 2009049006 | A2 | 4/2009 |

OTHER PUBLICATIONS

International Application No. PCT/US2009/058995 Search Report and Written Opinion dated Apr. 30, 2010.

* cited by examiner

*Primary Examiner* — Daniel P Stephenson
(74) *Attorney, Agent, or Firm* — Conley Rose, P.C.

(57) ABSTRACT

A pipe handling system includes a lifting mechanism coupled to an upper end of a pipe above a free end of the pipe, and a guide system operable to engage the pipe and control lateral movement of the pipe as it is moved between a storage position and a well center position, the guide system including a pair of support members including extendable end portions and a flexible pipe guide coupled between the extendable end portions. In some embodiments, the guide system includes a pair of rotatable support arms having first pivot ends and second ends and an expandable pipe guide connecting the second ends.

24 Claims, 18 Drawing Sheets

PIPE SECTION GUIDE SYSTEM WITH FLEXIBLE MEMBER

CROSS-REFERENCE TO RELATED APPLICATION

This application is the U.S. National Stage under 35 U.S.C. §371 of International Patent Application No. PCT/US2009/058995 filed Sep. 30, 2009, which claims the benefit of U.S. Provisional Patent Application No. 61/101,474 filed Sep. 30, 2008, entitled "Guide System For Pipe Section."

STATEMENT REGARDING FEDERALLY SPONSORED RESEARCH OR DEVELOPMENT

Not applicable.

BACKGROUND

The present disclosure relates generally to methods and apparatus for drilling earthen wells. More specifically, the present disclosure relates to systems for drilling earthen wells using joints of connectable pipe.

Drilling rigs require tubular members, such as drill pipe, drill collars, and casing, to be added or removed from the downhole tubular string in sections. The sections of tubular members may be stored in a setback area on or near the drilling rig. The sections of tubular members comprise three joints of pipe coupled together, for example, and the drilling rig is called a triple rig. In other examples, the pipe sections may comprise more or less pipe joints and the corresponding drilling rig may be called a quadruple rig, a double rig or a single rig. The tubular members may be stored vertically adjacent the rig, or horizontally away from the rig where they are transported to the rig and inclined toward the vertical position.

As the different tubular members are needed, they are brought to the drill floor one at a time and added to the string. Handling these tubular members has historically been a highly manual job using winches or other lifting appliances within the rig. Automated systems for use in drilling rigs must be able to safely handle a variety of tubular members while not slowing down drilling or tripping processes.

Thus, there remains a need to develop methods and apparatus for pipe handling and drilling systems, which overcome some of the foregoing difficulties while providing more advantageous overall results.

SUMMARY

A pipe handling system includes a pipe guide system with a flexible pipe guide that is operable to engage a pipe and control lateral movement of the pipe as it is moved between a storage position and a well center position. In some embodiments, the system includes a lifting mechanism coupled to an upper end of the pipe and the guide system includes a pair of support members including extendable end portions and a flexible pipe guide coupled between the extendable end portions. The flexible pipe guide may be expandable between the extendable end portions. The flexible pipe guide may include an expanded position engaging the pipe between extended positions of the end portions. The flexible pipe guide may include a contracted position releasing the pipe when the end portions are fully retracted. Support ends of the support members opposite the extendable end portions may be rotated about pivot points having multiple axes of rotation. The support members may be rotatable arms having offset axes of rotation.

In further embodiments, the system includes a rig structure to which the lifting mechanism and the guide system are coupled. The system may further include an elevated drill floor of the rig structure, a pipe erector operable to move a pipe from a horizontal storage position to an inclined position where an upper end of the pipe is adjacent to the elevated drill floor, wherein in the inclined position, the pipe is at an angle between horizontal and vertical and the upper end of the pipe is offset from well center, and wherein the guide system is operable to engage the pipe and control lateral movement of the pipe toward well center as the pipe is moved from being supported in the inclined position by the pipe erector to a vertical position supported by the rig, the support members extending to expand the flexible guide and engage the pipe between the inclined position and the vertical position, and the support members retracting to contract the flexible guide and release the pipe in the vertical position.

In additional embodiments, a pipe handling system includes a lifting mechanism coupled to an upper end of a pipe above a free end of the pipe, and a guide system operable to engage the pipe and control lateral movement of the pipe as it is moved between a storage position and a well center position, the guide system including a pair of rotatable support arms having first pivot ends and second ends and an expandable pipe guide connecting the second ends. The pivot ends may each include a pivot point having an axis of rotation. The axes of rotation may be different. The axes of rotation may be angled relative to each other. The axes of rotation may be offset. The expandable pipe guide may include a cable including a roller assembly. A drive mechanism may be included to rotate the pair of arms about the pivot ends. A frame may be included to support the pivot ends. The frame may include bend plates supporting the pivot ends at offset angles. The arms may include angled levers and intermediate bends.

In some embodiments, a pipe handling method includes supporting an upper end of a pipe with a lifting mechanism, extending a flexible pipe guide, and engaging the pipe with the extended flexible pipe guide to control lateral movement of the pipe. The method may include expanding the flexible pipe guide to engage the pipe and contracting the flexible pipe guide to release the pipe. The method may include moving the pipe from a storage position toward a well center position by retracting pipe guide support arms and contracting the flexible pipe guide between the support arms. The method may include moving the pipe from a well center position toward a storage position by extending pipe guide support arms and expanding the flexible guide between the support arms. The method may include retracting and contracting the flexible pipe guide, aligning the pipe with a drill string supported by a drilling rig, disengaging the pipe from the flexible pipe guide, and engaging the pipe with the drill string.

Thus, the embodiments herein include a combination of features and advantages that enable substantial enhancement of moving pipe and other tubular members to and from a drilling rig. These and various other characteristics and advantages of the present disclosure will be readily apparent to those skilled in the art upon reading the following detailed description of the embodiments and by referring to the accompanying drawings.

BRIEF DESCRIPTION OF THE DRAWINGS

For a more detailed description of the embodiments of the disclosure, reference will now be made to the accompanying drawings, wherein.

DETAILED DESCRIPTION

Figure 1:
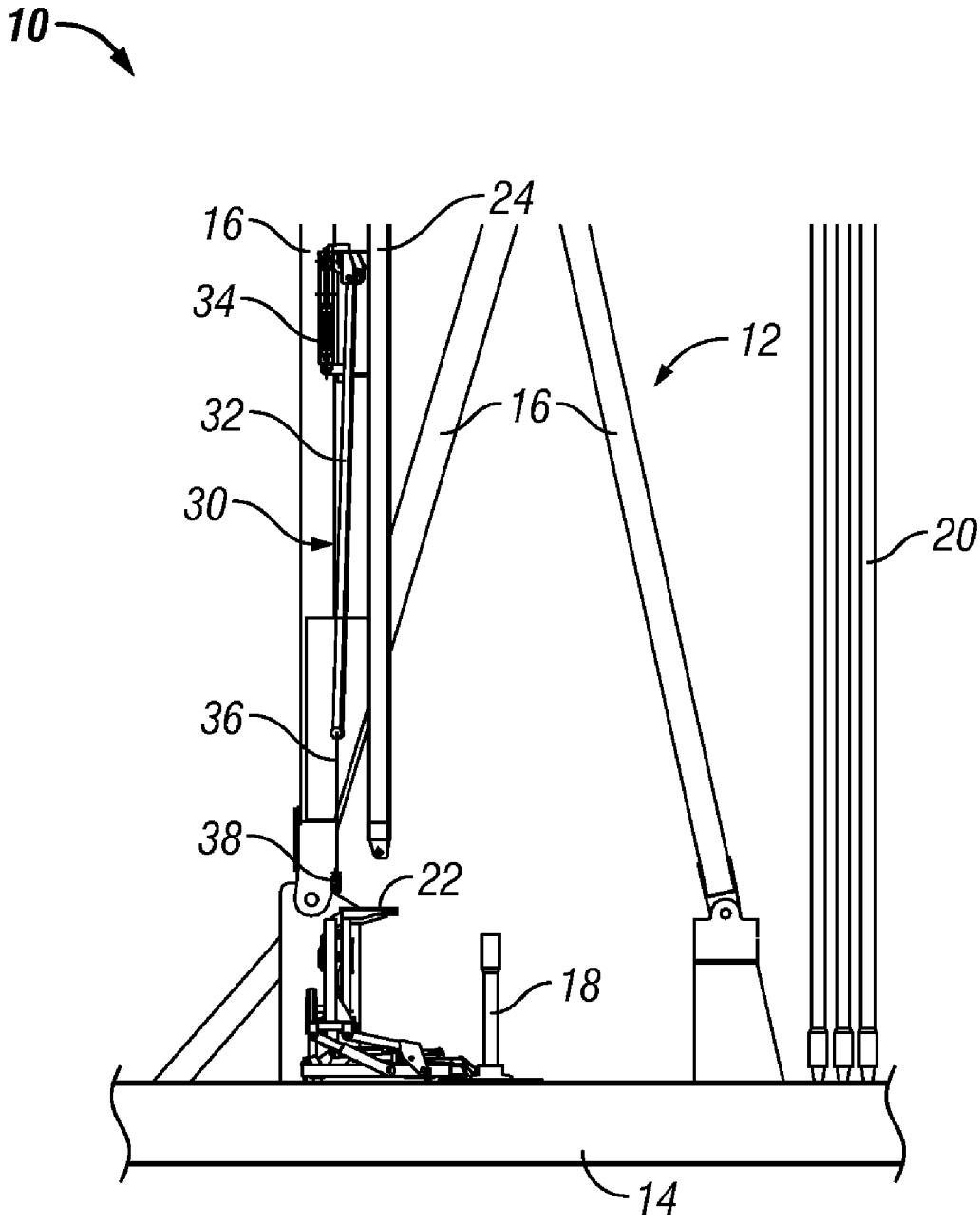
FIG. 1 is an elevation view of a drilling system including an embodiment of a pipe guide system in accordance with principles set forth herein.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. The use of pipe or drill pipe herein is understood to include casing, drill collar, and other oilfield and downhole tubulars. In the following discussion and in the claims, the terms "including" and "comprising" are used in an open-ended fashion, and thus should be interpreted to mean "including, but not limited to . . . ". The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a drilling system 10 includes a rig structure 12 having a drill floor 14 and a mast or derrick 16. A drill string 18 extends through the drill floor 14. A series of pipe joint sections 20 or other tubular members is set back from the drill string on the drill floor 14, waiting to be added to the drill string 18. In exemplary embodiments, the triple pipe joint sections 20 include three connected pipe joints. In other exemplary embodiments, the pipe joint sections include two or four pipe joints. A stabbing system 22 is disposed on the drill floor 14 adjacent the drill string 18. In exemplary embodiments, the stabbing system 22 may be a combination unit including slips, a pipe lubricator, a mud bucket and other systems used in making up or breaking out pipe joints. A torque tube 24 or other support structure extends downward from a top drive system (shown elsewhere herein). A pipe guide system 30 is coupled to the tube 24, and includes an arm 32, or pair of arms 32, a drive mechanism 34, a flexible line or cable 36, and a roller assembly 38. In exemplary embodiments, the pipe guide system is coupled to the mast or derrick 16.

Figure 2A:
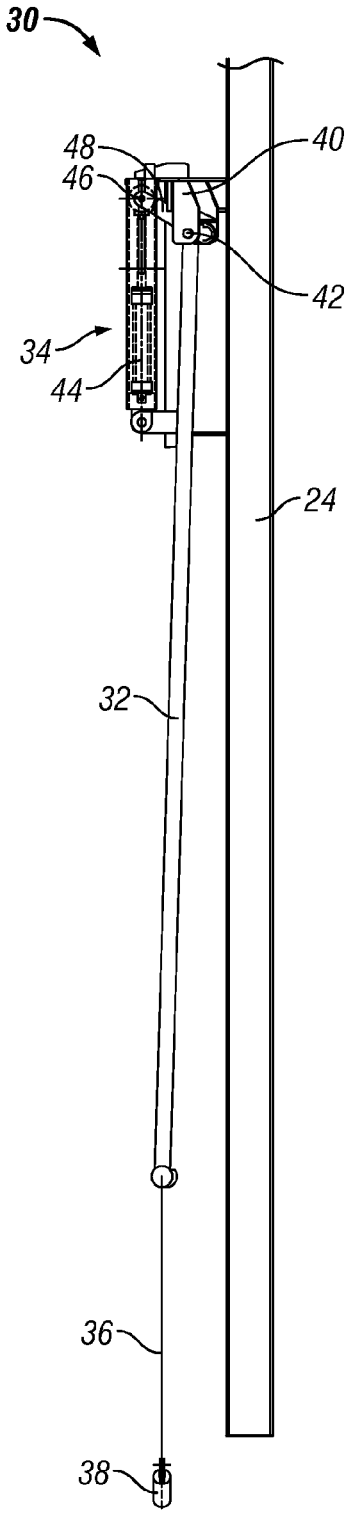
FIG. 2A is an enlarged side view of the pipe guide system of FIG. 1.

Referring now to FIG. 2A, a side view of the pipe guide system 30 is shown. The drive mechanism 34 includes a support frame 40 coupled to the tube 24. The frame 40 couples to the arm 32 at a pivot point 42. The frame 40 supports a hydraulic cylinder 44 that couples to a pivot point 46 at the end of an arm lever 48 attached at the end of the arm 32. The other end of the arm 32 is coupled to the cable 36 and roller assembly 38.

Figure 2B:
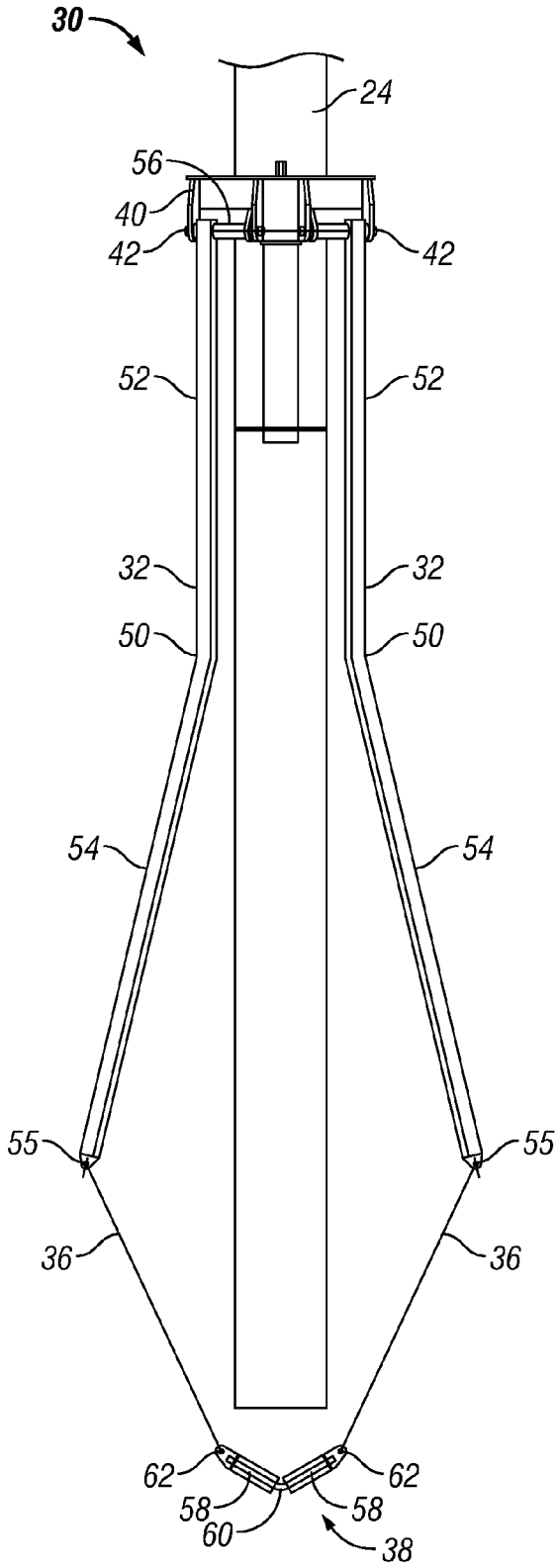
FIG. 2B is a front view of the pipe guide system of FIG. 2A.

Referring next to FIG. 2B, a front view of the pipe guide system 30 is shown. Each of the pair of arms 32 includes an intermediate bend 50 separating an upper arm 52 from a lower arm 54. An arm hub 56 at the upper ends of the arms 32 provides the pivot point 42 for moveably coupling the arms 32 to the frame 40. Cable eyes 55 at the lower end of the arms 32 receive the cable 36, which also attaches to the roller assembly 38 at cable eyes 62. The roller assembly 38 also includes a bent or V-shaped axle 60 rotatably supporting rollers 58.

Figure 3A:
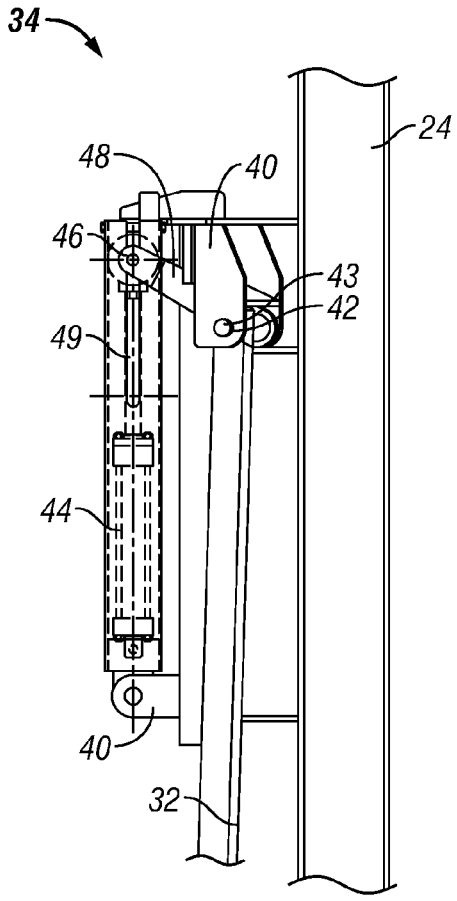
FIG. 3A is an enlarged view of a drive mechanism of the pipe guide system of FIG. 2A.
Figure 3B:
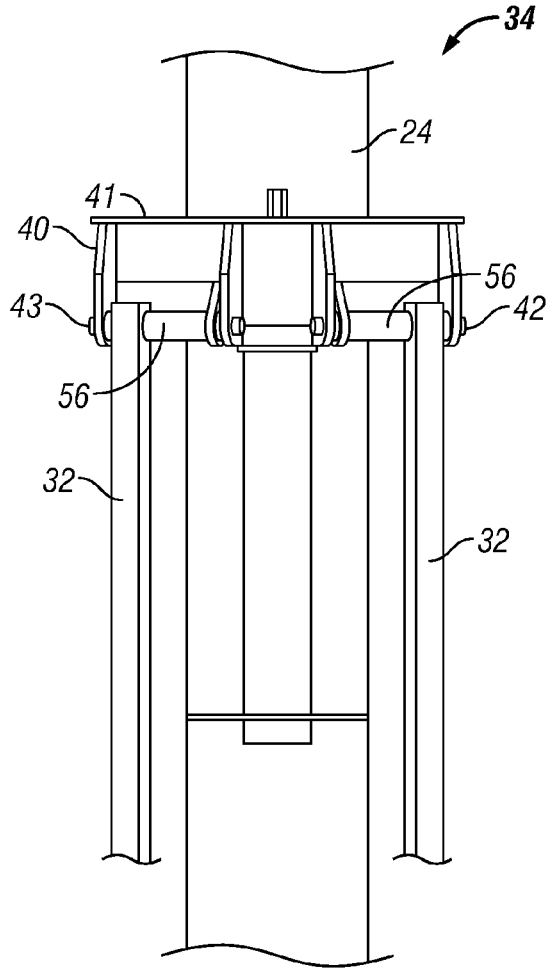
FIG. 3B is a front view of the drive mechanism of FIG. 3A.
Figure 3C:
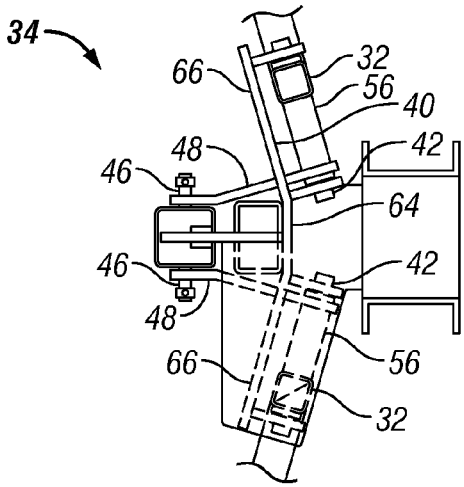
FIG. 3C is a top view of the drive mechanism of FIG. 3A.

Referring to FIGS. 3A-3C, enlarged views of the drive and pivotal arm support mechanism 34 are shown. In FIG. 3A, a side view shows that the arm 32 pivotally couples to the frame 40 via a pin 43 inserted through a frame plate at pivot point 42. The arm lever 48 pivotally couples to a piston rod 49 at pivot point 46, and the hydraulic cylinder 44 provides the actuation forces to move the piston rod 49 up and down to create a lever action in the arm 32. As shown in FIG. 3B, the frame 40 having top plate 41 pivotally supports the arms 32 at the pivot points 42 by running a pin 43 through the frame 40 and the arm hubs 56.

Referring now to FIG. 3C, a top view of the mechanism 34 is shown. The frame 40 includes an intermediate straight plate 64 and a pair of bend plates 66 extending at an angle from opposite sides of the plate 64. The bend plates couple to and support the arms 32 via the pivotal couplings 42 and the hubs 56. Further, the arm levers 48 extending from the hubs 56 and connecting to the pivotal couplings 46 also include bends, as shown. The angled or bent plates 66 and arm levers 48 assist in providing the extension or tightening action of the cable 36 for receiving pipe sections, as will be explained more fully herein.

Figure 4A:
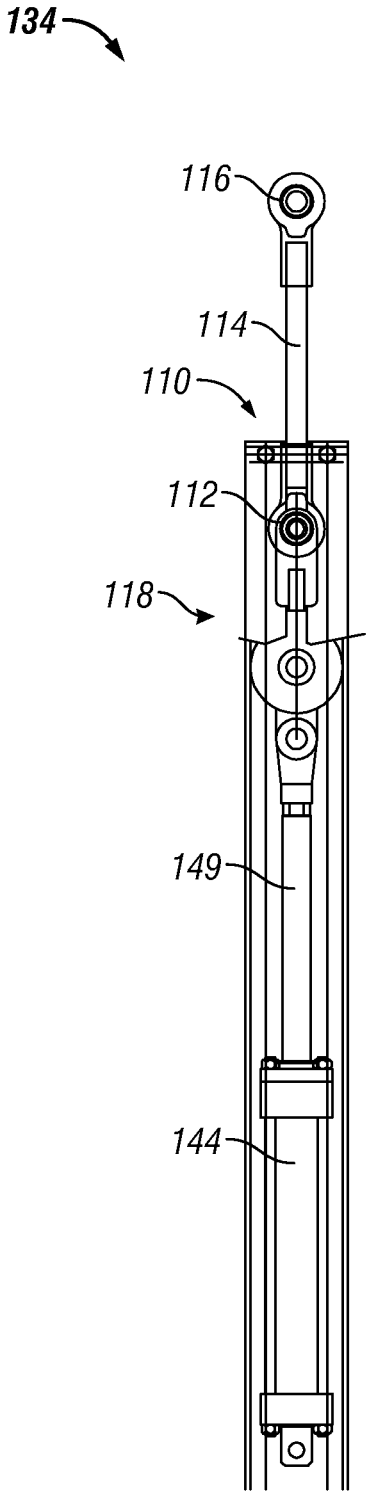
FIG. 4A is a side view of an alternative embodiment of a drive mechanism.
Figure 4B:
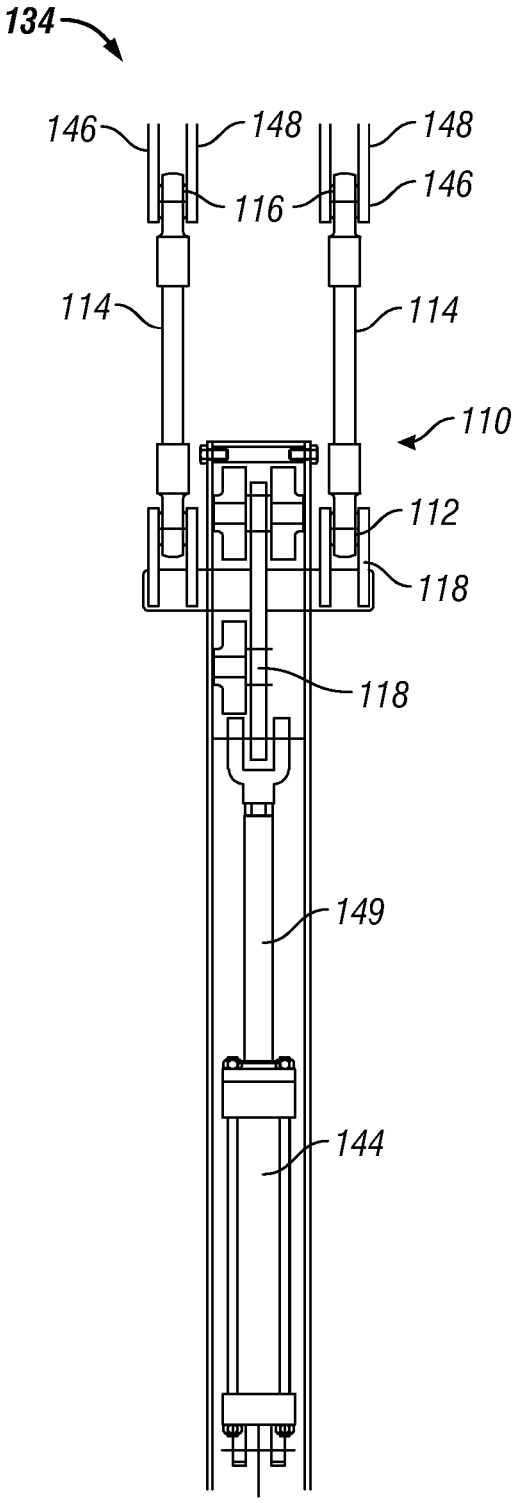
FIG. 4B is a front view of the drive mechanism of FIG. 4A.

In exemplary embodiments, the mechanism 34 is replaced with a mechanism 134, shown in FIGS. 4A and 4B. In FIG. 4A, a side view of the mechanism 134 shows that a hydraulic cylinder 144 provides actuation forces to a piston rod 149 coupled to a linkage assembly 118. The linkage assembly 118 pivotally and rotatably couples to a ball end 112 of a rod 114. The opposite end 116 of the rod 114 also includes a ball member for pivotally and rotatably coupling to an arm lever 148 (equivalent to the lever 48 of FIGS. 3A and 3C) at pivot point 146 (equivalent to the pivot 46 of FIGS. 3A and 3C). The ball couplings at the ends of the rod 114 provide additional degrees of freedom in movement between the drive mechanism and the extendable guide arms, thereby further facilitating the relative separation of the lower ends of the two guide arms as they extend toward the pipe joints 20. The movement of the lower ends of the guide arms away from each other causes the cable to extend lengthwise, or tighten, such that the roller assembly will receive a pipe section, as will be further described herein.

Figure 5A:
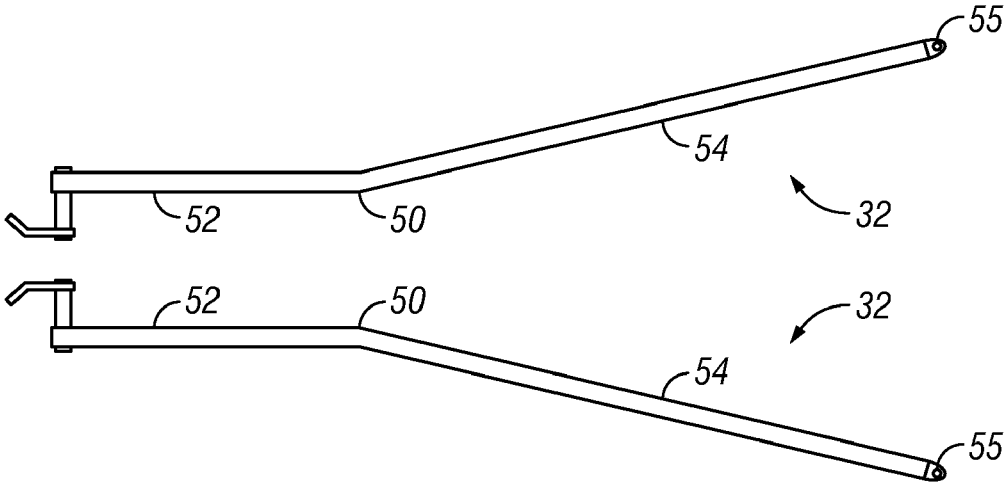
FIG. 5A is an elevation view of a pair of guide arms of the pipe guide system of FIG. 1.
Figure 5B:
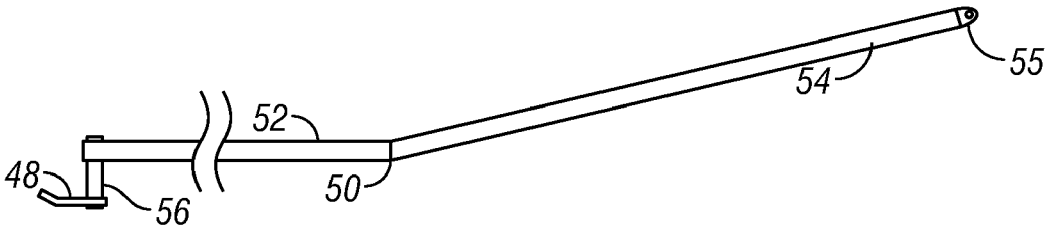
FIG. 5B is an enlarged top view of one of the guide arms of FIG. 5A.
Figure 5C:
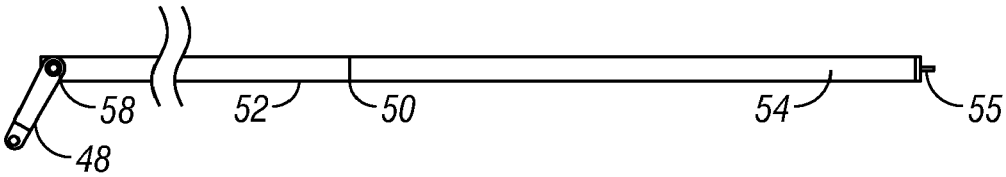
FIG. 5C is a side view of the guide arm of FIG. 5B.

Referring next to FIGS. 5A-5C, different views of the guide arms 32 are shown. In FIG. 5A, the pair of arms 32 include upper arms 52 and lower arms 54 separated by the bends 50. In FIGS. 5B (top view) and 5C (side view), the arm 32 also includes a lowermost end having the cable eye 55 and an uppermost end including the hub 56 and the arm lever 48.

Figure 6:
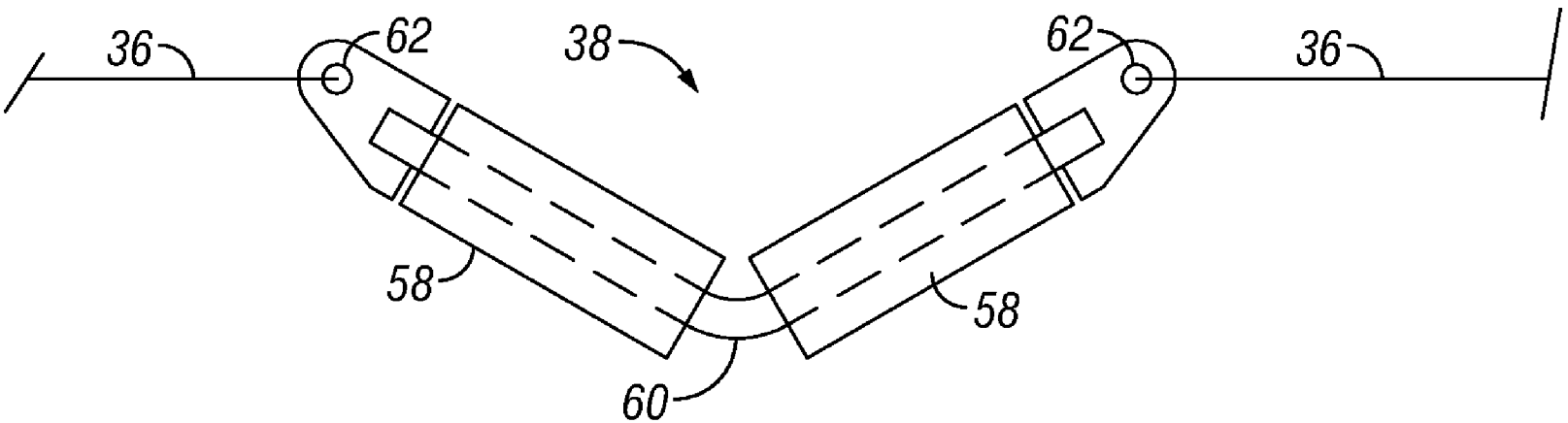
FIG. 6 is an elevation view of a flexible guide member and roller assembly of the pipe guide system of FIG. 1.

Referring to FIG. 6, the roller assembly 38 includes the bent support axle 60, the rollers 58, and the cable eyes 62 for coupling to the cable 36.

Figure 7A:
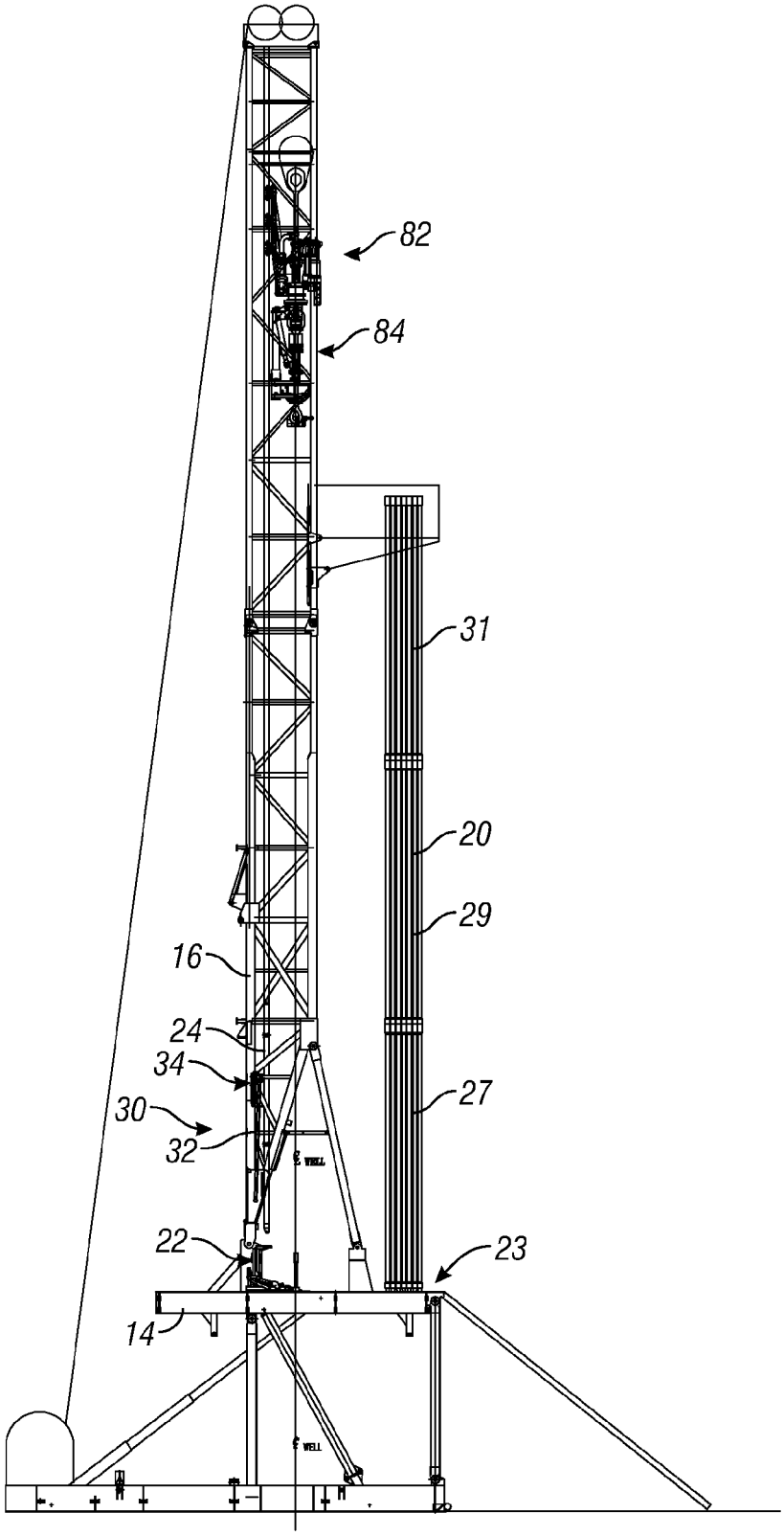
FIGS. 7A-7H illustrate an operating process using the drilling system of FIG. 1.

In operation, the pipe guide system 30 provides an automated means for handling and guiding pipe joint sections and other oilfield tubulars while they are moved about the drill floor. Referring now to FIGS. 1 and 7A-8D, the different stages of operation are illustrated. In FIGS. 1 and 7A, a group of triple joint sections 20 is stored in a setback or storage area 23 waiting to be made up with the drill string 18. The sections 20 include first pipe joints 27, second pipe joints 29 and third pipe joints 31. The stabbing system 22 and the pipe guide system 30 are in retracted positions. As previously noted, the stabbing system 22 may be a combination unit including slips, a pipe thread lubricator, a mud bucket and other systems used in making up or breaking out pipe joints. The drive mechanism 34 of the pipe guide system 30 is disengaged to allow the arms 32, the cable 36, and the roller assembly 38 to hang in a downward position. As shown in FIG. 2B, the arms 32 hang downward causing the cable 36 to be in a relaxed or contracted position about the roller assembly 38. The upper portion of the rig structure 16 supports a top drive system 82 including a pipe elevator 82.

Figure 7C:
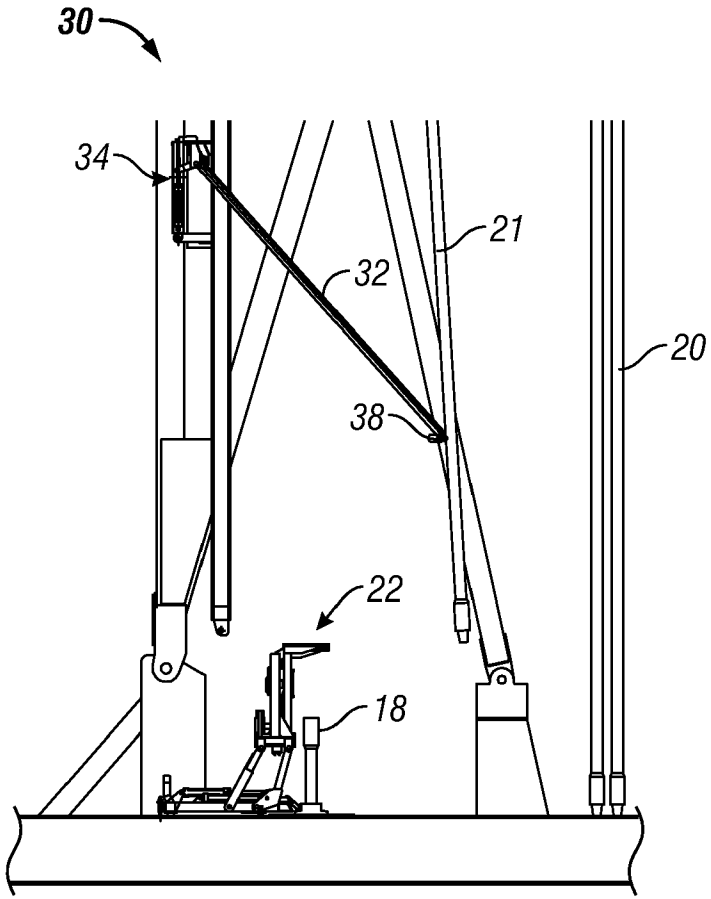
Figure 7B:
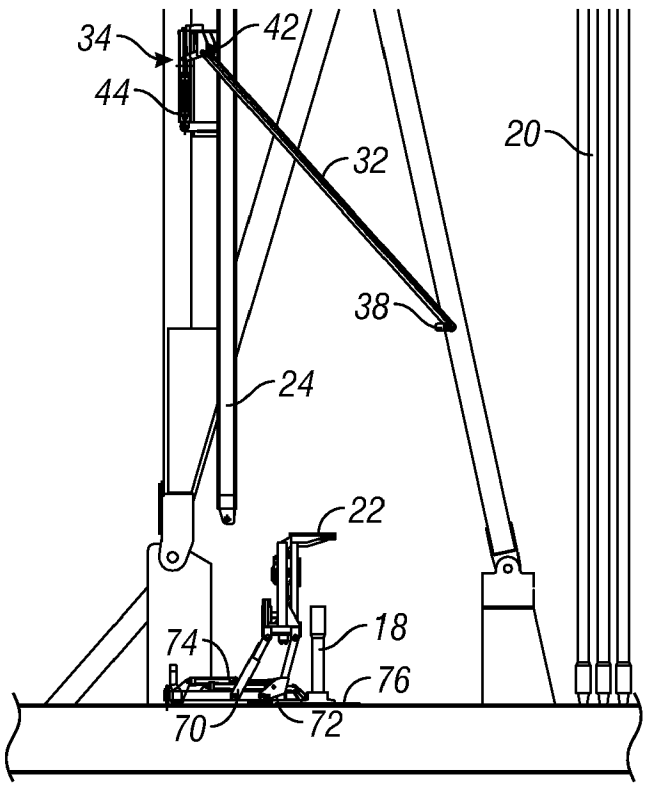

Referring next to FIG. 7B, the stabbing system 22 is extended to a position above the drill string 18 by actuating the hydraulic cylinders 74, or other drive mechanism, and pivoting the supports arms 70, 72. Additionally, the drive mechanism 34 is actuated and the hydraulic cylinder 44 pivots the arms 32 about the pivot point 42. Referring back to FIGS. 3A-3C, the hydraulic cylinder 44 is actuated to retract the piston rod 49 and exert a downward force on the pivotal couplings 46 and the ends of the arm levers 48. The arm levers 48 rotate about the pins 43 at the pivot points 42, thereby transferring a rotational force to the arms 32 and extending them to the position shown in FIG. 7B.

Figure 8A:
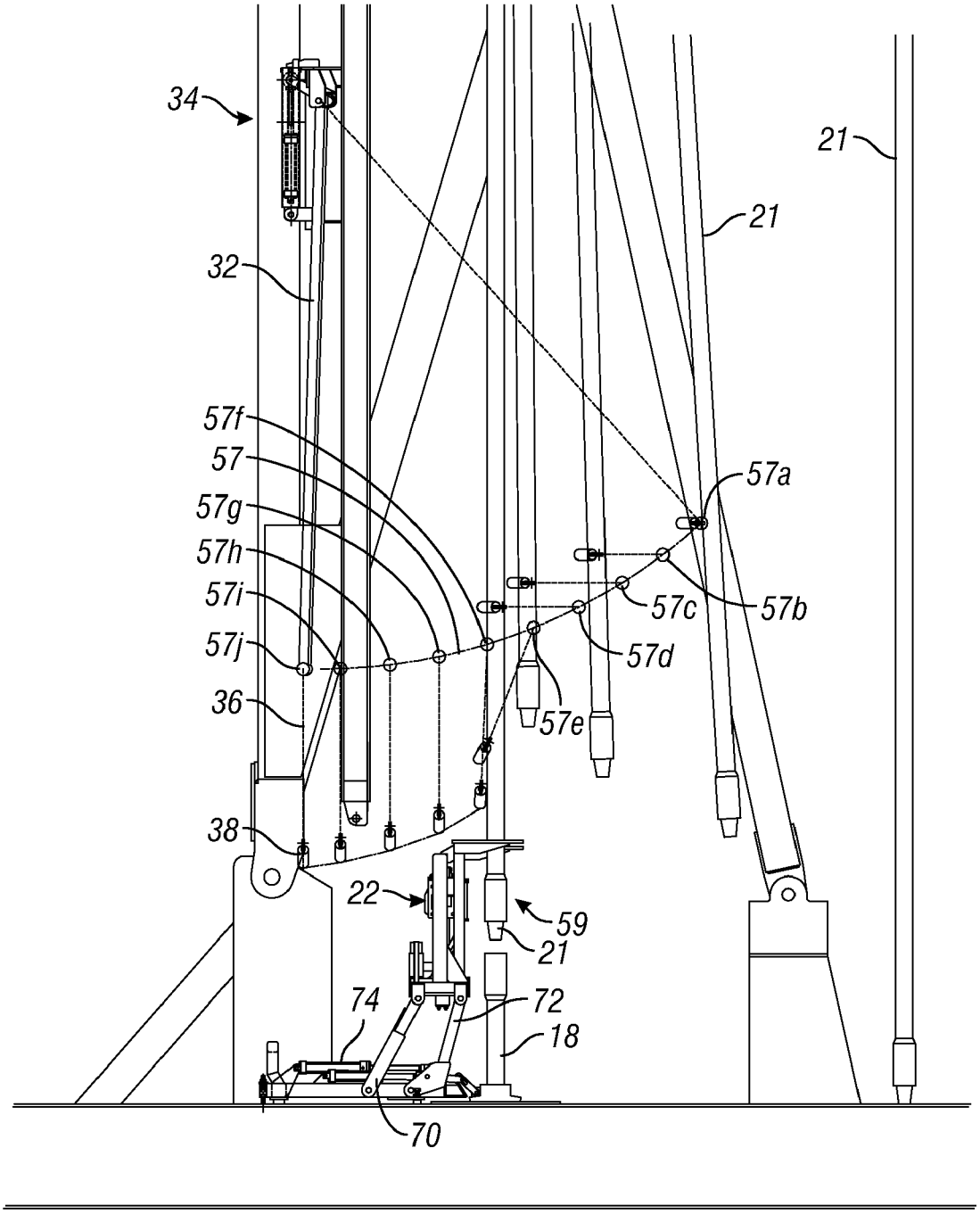
FIG. 8A is an enlarged view of FIG. 7D showing the range of motion of the pipe guide system.
Figure 8B:
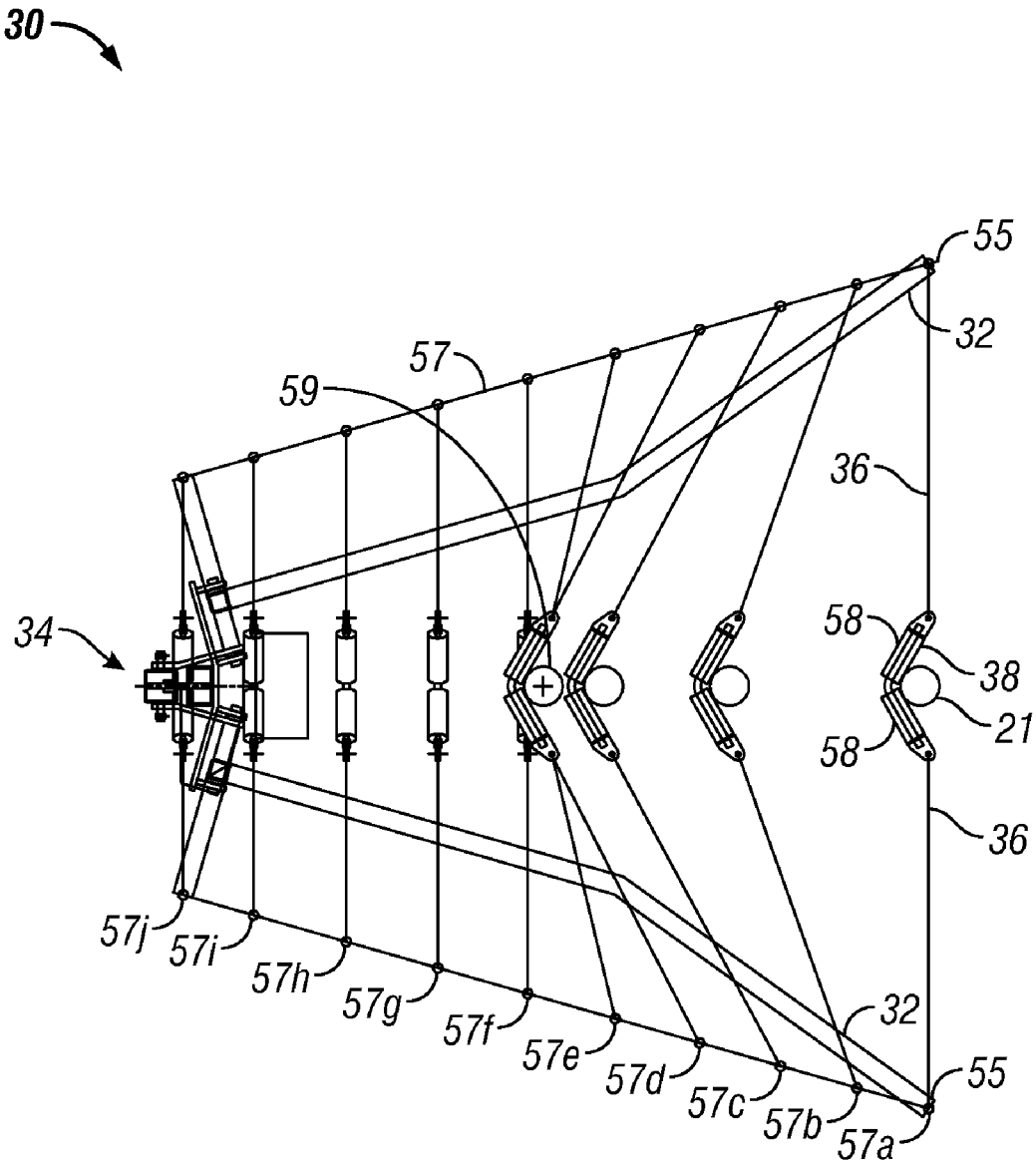
FIG. 8B is a top view of FIG. 8A.

Referring now to FIGS. 8A and 8B, the extended position of FIG. 7B also corresponds to the position 57*a* wherein the rotation of the arms 32 extends and tightens the cables 36 as the ends 55 of the arms 32 move away from each other. The ends 55 move away from each other while the arms 32 move from the position of FIG. 7A to the position of FIG. 7B by virtue of the angled plates 66 of the support frame 40. The angled support plates, along with the angled lever arms 48 and the bends 50 (see also FIGS. 5A and 5B), cause the ends 55 to move away from each other as the arms 32 extend outwardly, and move back toward each other as the arms 32 are brought back toward vertical alignment. The extension of the cable 36 may also be facilitated by a ball coupling assembly as shown in FIGS. 4A and 4B.

Referring now to FIG. 7C, the single pipe section 21 is picked up by a pipe elevator of a top drive assembly. As the pipe section 21 is moved toward well center at the drill string 18 and the extended stabbing system 22, it will tend to swing, often times uncontrollably, and be a danger to rig personnel and equipment. As shown, the pipe guide system 30 engages or catches the pipe section 21 as it begins moving toward well center. The pipe section 21 is gathered and stabilized by the roller assembly 38. If the pipe section 21 is misaligned from the roller assembly 38 as it engages the guide system 30, the cable 36 will direct the moving pipe section 21 toward the roller assembly 38. In some embodiments, slack in the cable 36 and flex in the arms 32 provide cushion for the pipe section 21 as it swings into the guide system 30. However, spring-back reaction forces may be created in the guide system 30. As the pipe section 21 impacts the guide system 30, a hydraulic pressure spike is created in the hydraulic fluid system coupled to the hydraulic cylinder 44, resulting in spring-back. In an exemplary embodiment, a relief valve is provided in the drive mechanism 34 and coupled to the hydraulic cylinder 44 to relieve hydraulic pressure and absorb the impact of the swinging pipe section 21.

Figure 7E:
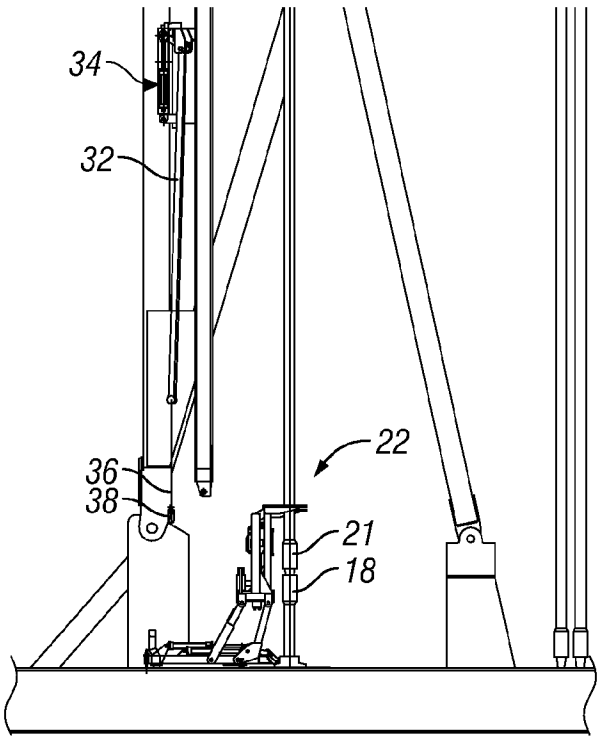
Figure 7D:
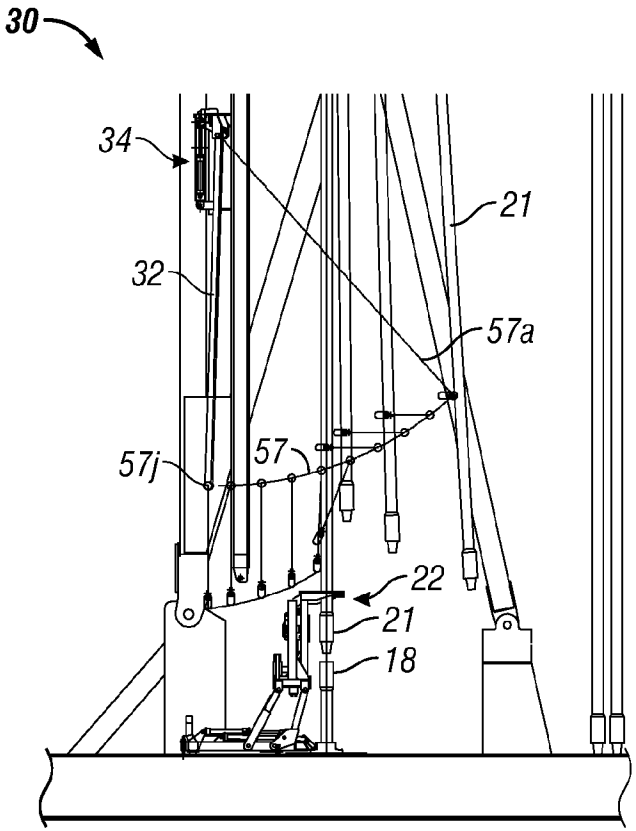

Referring now to FIG. 7D, the drive mechanism 34 is actuated to provide a controlled retraction of the guide system 30 such that the arms 32 travel through a range 57 of positions, from the extended and receiving position 57*a* to the fully retracted position 57*j*. The controlled retraction of the guide system 30 brings the pipe section 21 to well center above the drill string 18 and into the grasp of the stabbing system 22.

Figure 8C:
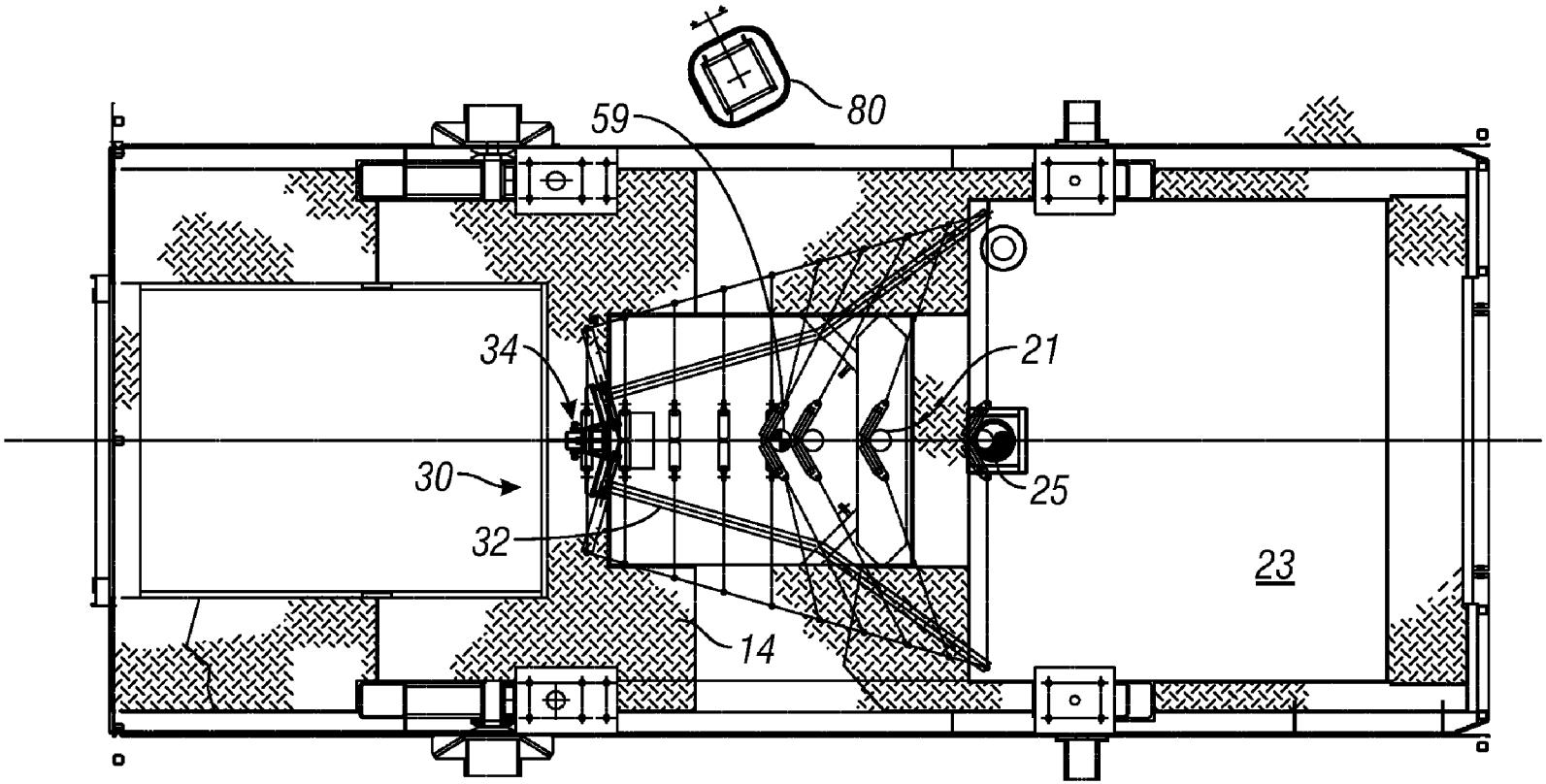
FIG. 8C is a top view of the drilling system of FIGS. 8A and 8B disposed on a fully equipped drill floor.

Briefly referring to FIGS. 8A-8C, the range 57 of positions of the guide system 30 is shown in more detail. At position 57*a*, the drive mechanism 34 has extended the arms 32 and the ends of the arms 32 have moved apart to pull the cable 36 tight on either side of the roller assembly 38. As previously described, the ends of the arms 32 move away from each other as the arms extend because the pivot points of the arms 32 do not share the same axis or have parallel axes, instead having rotational axes which are angled relative to one another. Referring back to FIG. 3C, the plates 66 of the frame 40 support a pair of pins 43 that are angled relative to the center plate 64 and angled relative to each other. The offset longitudinal axes of the pins 43 provide the offset rotational axes of the pivot points 42, about which the arms 32 rotate. Thus, as the hydraulic cylinder 44 and the piston rod 49 pull on the levers 48, the arms 32 rotate about offset or angled axes such that the ends of the arms 32 move from proximate positions while the arms 32 are vertically disposed to displaced positions as the arms 32 extend outwardly toward horizontal. The angled lever arms 48 and the bends 50 also facilitate relative movement of the ends of the arms 32. Furthermore, other means for providing relative movement of the arm ends are also contemplated, such as the drive mechanism 134 of FIGS. 4A and 4B.

Figure 7G:
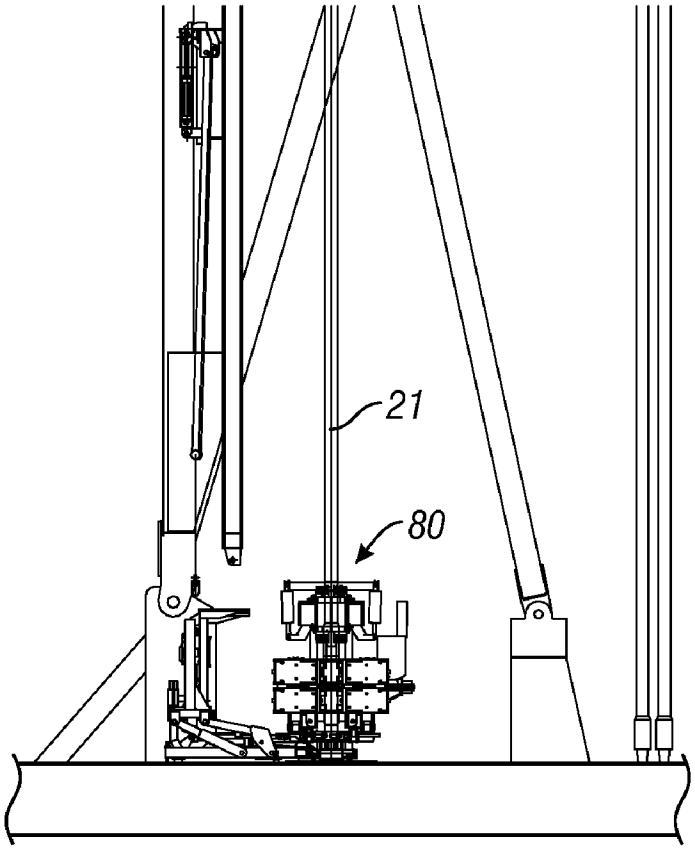
Figure 7F:
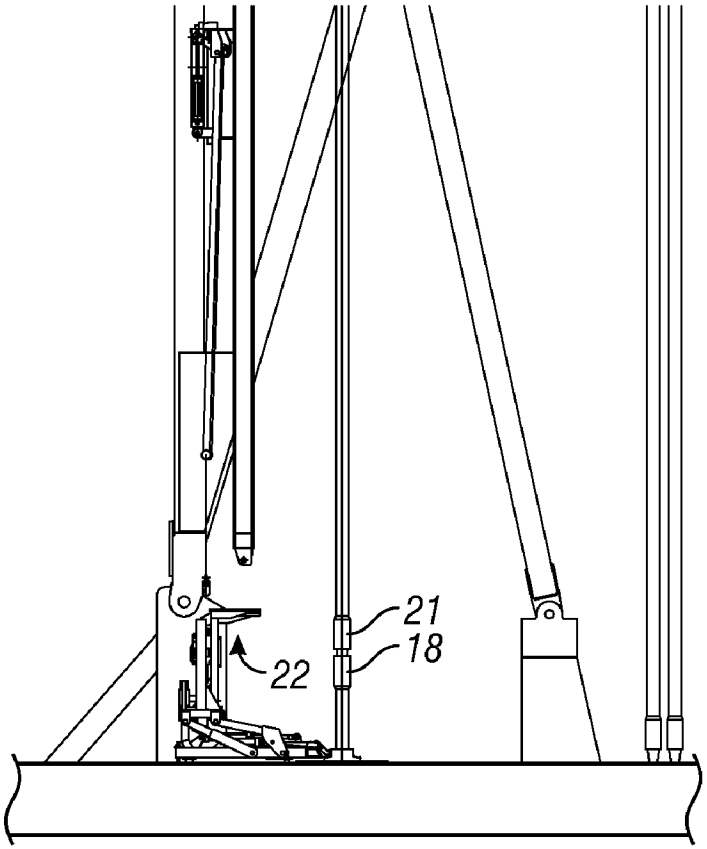
Figure 7H:
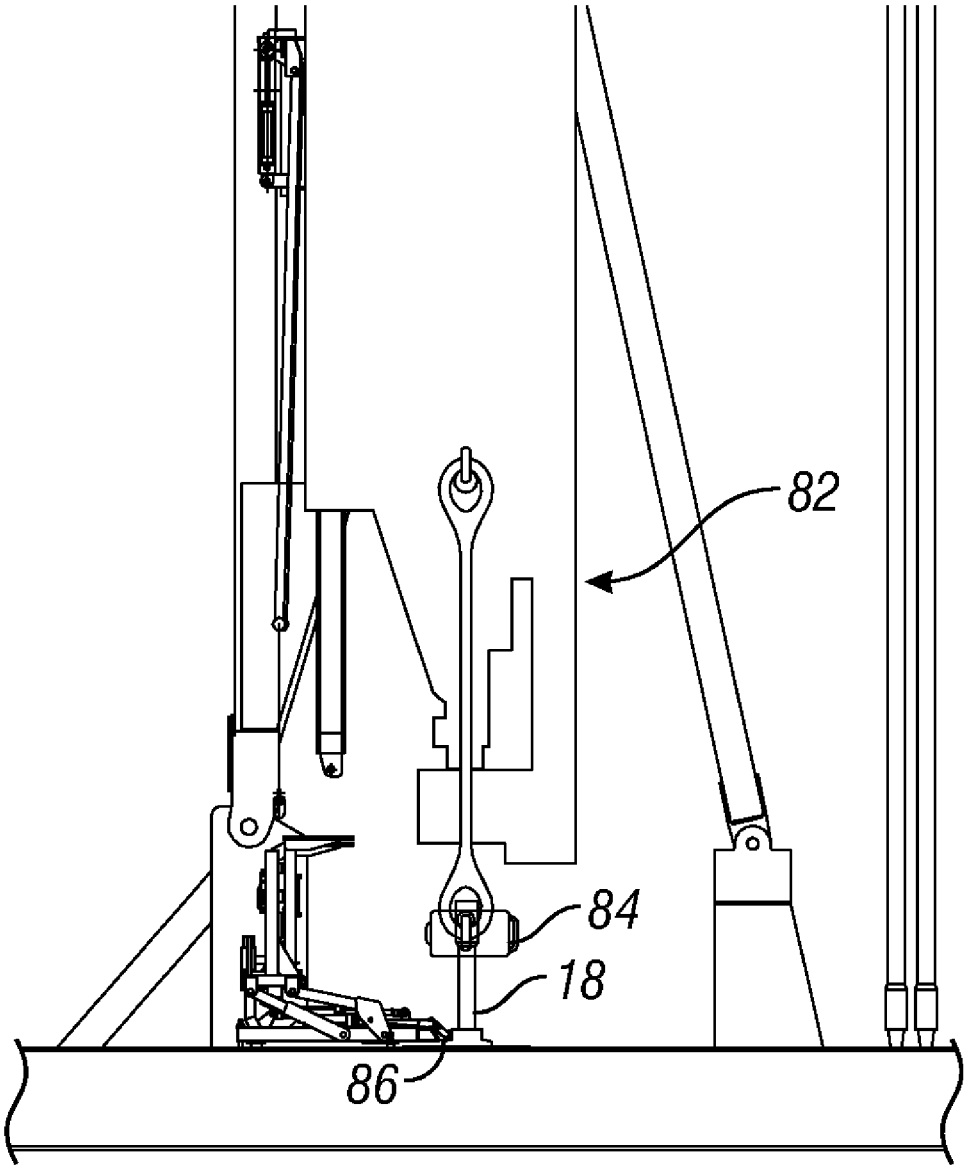

Also at position 57*a*, the pipe section 21 is moved by a pipe elevator and top drive system, such as those shown in FIG. 7H, from a storage position in the setback area to the cable 36 and the roller assembly 38. The swinging pipe section 21 will be received and guided to the roller assembly 38 as previously described, while also absorbing the impact of the pipe section 21. Next, the arms 32 are retracted by the drive mechanism 34 to a position 57*b*. The lines 57 track the motion of the ends 55 of the arms 32 as they travel through the positions described. At a position 57*b*, the ends 55 have begun to move back toward each other and the cable 36 has slackened. As this occurs, the rollers 58 allow the roller assembly to roll down vertically along the pipe section 21. At positions 57*c* and 57*d*, the ends 55 continue to move toward each other, causing the cable 36 to further slacken and the roller assembly 38 to move further down the pipe section 21 as the pipe section moves laterally toward a well center position 59. At a position 57*e*, the pipe section 21 is located at the well center position 59 and is stabilized there by the controlled retraction of the pipe guide system 30. At positions 57*f* and 57*g*, the roller assembly 38 disengages from the vertically disposed and substantially still pipe section 21. The cable 36 continues to slacken due to the relative movement of the ends 55 toward each other. At positions 57*h* and 57*i*, the arms 32 continue to retract and move the roller assembly 38 and the cable 36 laterally toward the original retracted position 57*j*.

In exemplary embodiments, the cable 36 is a steel cable. In other embodiments, the cable 36 is a length of an elastomeric material that stretches over the expanding and contracting distance between the ends 55 of the extendable support arms 32. The elastomeric line 36 may or may not include the roller assembly 38. In some embodiments, the elastomeric line 36 includes a receiving member for capturing the pipe section 21 rather than the roller assembly 38. In still other embodiments, the cable 36 includes rigid members. A first rigid member is coupled between the first arm end 55 and the first roller assembly eye 62, and a second rigid member is coupled between the second arm end 55 and the second roller assembly eye 62. The couplings at 55, 62 are rotatable to allow the expansion and contraction of the overall expandable guide member 36. In the various embodiments, the flexibility of the guide member 36, 38 allows for expansion and contraction between the ends 55 of the extendable support arms 32. The retracted arms 32 and contracted guide member 36, 38 provide a space efficient, stored pipe guide system. When extended and expanded, the arms 32 and the guide member 36, 38 are flexible to laterally transport pipe sections in a safe manner.

Referring to FIG. 8C, the pipe guide system 30 is disposed on a fully equipped drill floor 14 including the setback area 23, a mousehole 25, the pipe section 21 engaged with and placed by the guide system 30 to the well center position 59, and an iron roughneck 80 for applying torque to the pipe section 21.

Now, referring back to the drill floor operation incorporating the pipe guide system 30, FIG. 7E illustrates centralizing the pipe section 21 by the elevator and stabbing of the lower end of the pipe section 21 by the stabbing system 22. In some embodiments, wherein the stabbing system 22 is a combination unit, a lubricator operably coupled thereto may be actuated to lubricate the pipe threads on the pipe section 21 and/or the drill string 18. In FIG. 7F, the stabbing system or combination unit 22 is retracted to leave the connected pipe section 21 available to receive the iron roughneck 80. In FIG. 7G, the iron roughneck 80 is moved adjacent the connection between the pipe section 21 and the drill string 18. The iron roughneck 80 engages the pipe section 21 and spins it to torque it up with the drill string 18. The pipe section 21 is now part of the drill string 18. As illustrated in FIG. 7H, the top drive 82 with elevator 84 moves the drill string 18 down to a position where it can receive another pipe section. In an exemplary embodiment, the combination unit 22 may include a slip system 86 for engaging the drill string 18 at this time. In exemplary embodiments, the combination unit 22 may also include a mud bucket for surrounding the connection and receiving mud as a pipe section is broken out from the drill string 18.

Various combinations of the steps just described are also used to perform additional operations. For example, a reverse order of the steps generally described with reference to FIGS. 7A-7H may be executed during a tripping out process. The extension of the pipe guide system 30 may be used to push a tripped out pipe section 21 back toward the storage setback area 23.

Figure 9:
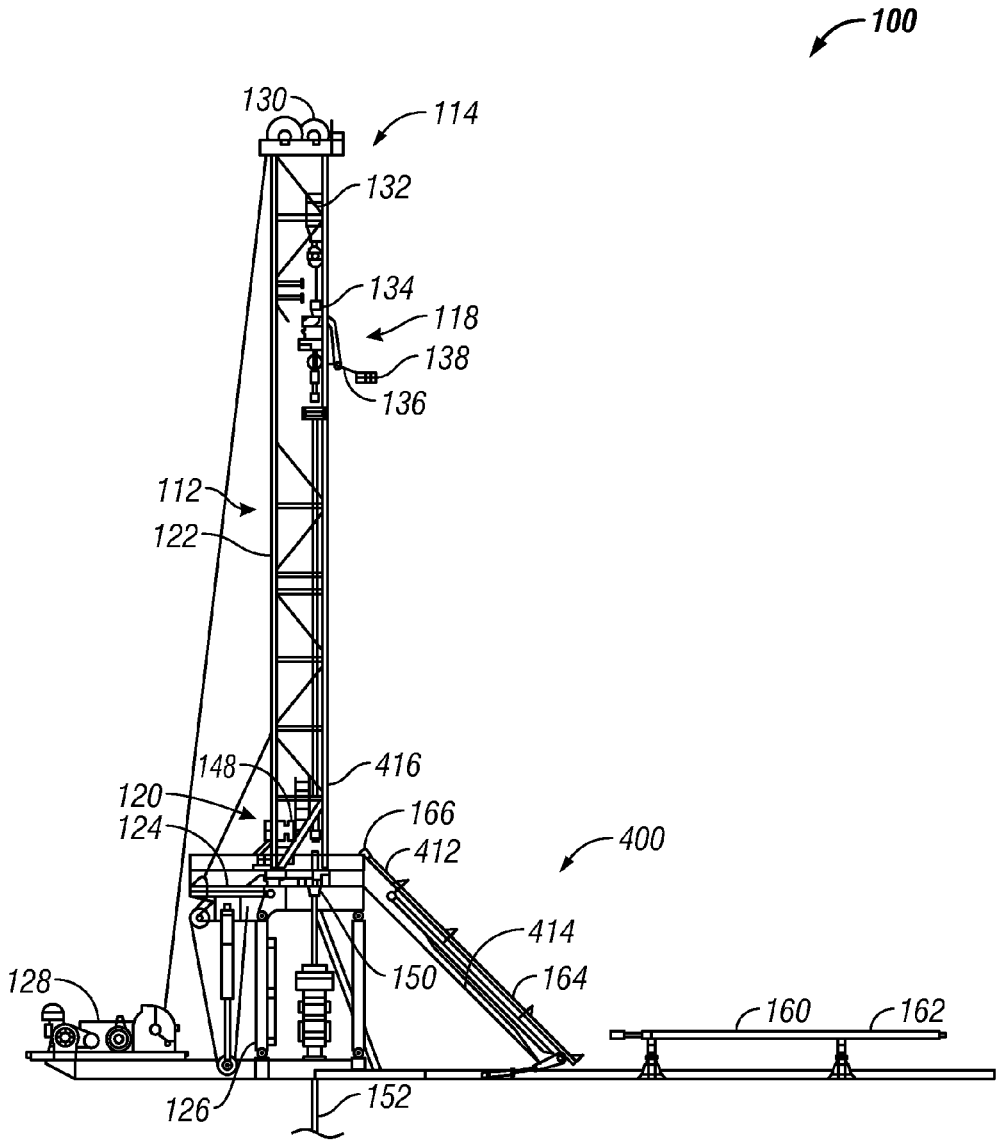
FIG. 9 is an elevation view of an exemplary drilling system with a pipe erector.

Referring now to FIG. 9, some embodiments of the drilling system with the pipe guide system 30 may include a pipe erector and other components. A drilling system 100 comprises a rig structure 112, a hoisting system 114, a pipe erector system 400, a top drive system 118, and drill floor equipment 120. The rig structure 112 comprises a mast 122, an elevated drill floor 124, and a sub-structure 126. The hoisting system 114 comprises drawworks 128, a crown block 130, and a traveling block 132. The top drive system 118 comprises a top drive 134, bails 136, and an elevator 138. The drill floor equipment 120 comprises an iron roughneck system 148 and slips 150 that are located on well center 152. The pipe erector system 400 moves the drill pipe 160 from a horizontal storage position 162 to an inclined position 164 where the upper end 166 of the drill pipe is substantially adjacent to the elevated drill floor 124.

Figure 10:
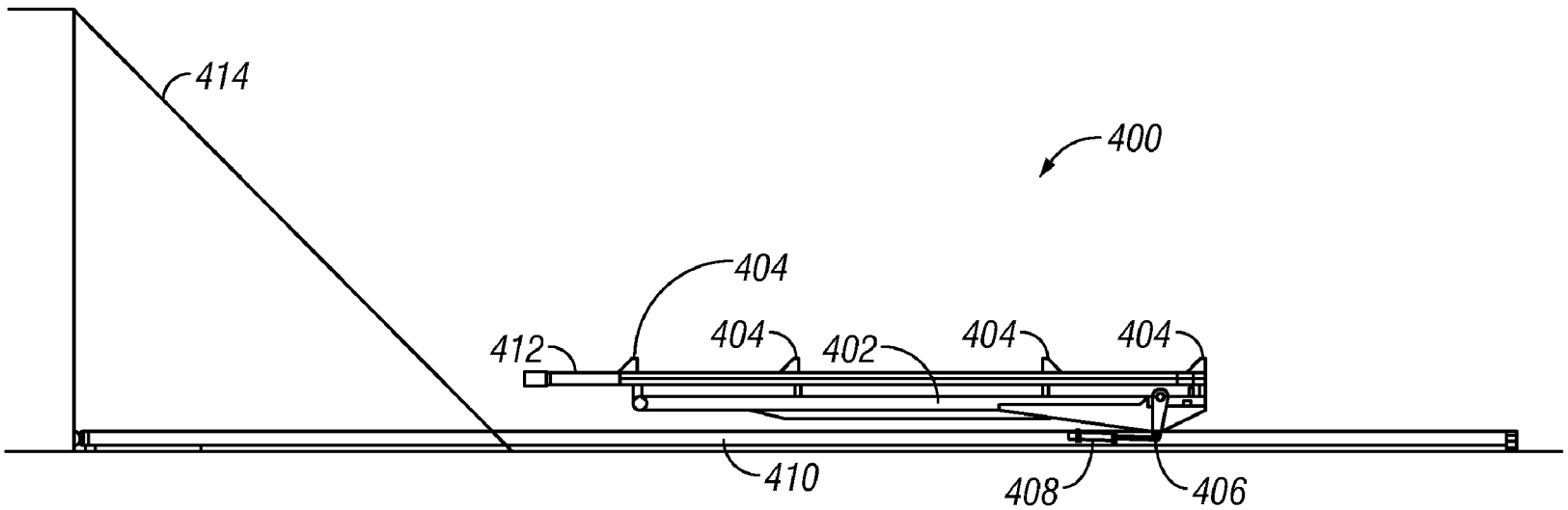
FIGS. 10-12 are enlarged views of the pipe erector moving a pipe section from a horizontal position to an inclined position toward the rig structure.
Figure 11:
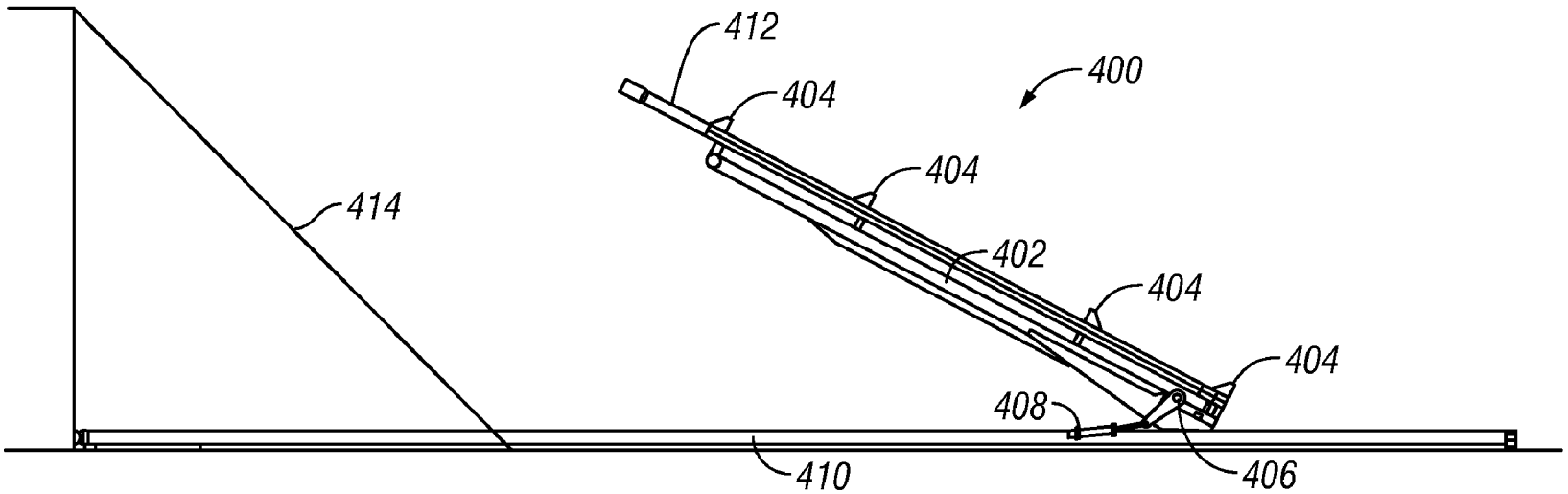
Figure 12:
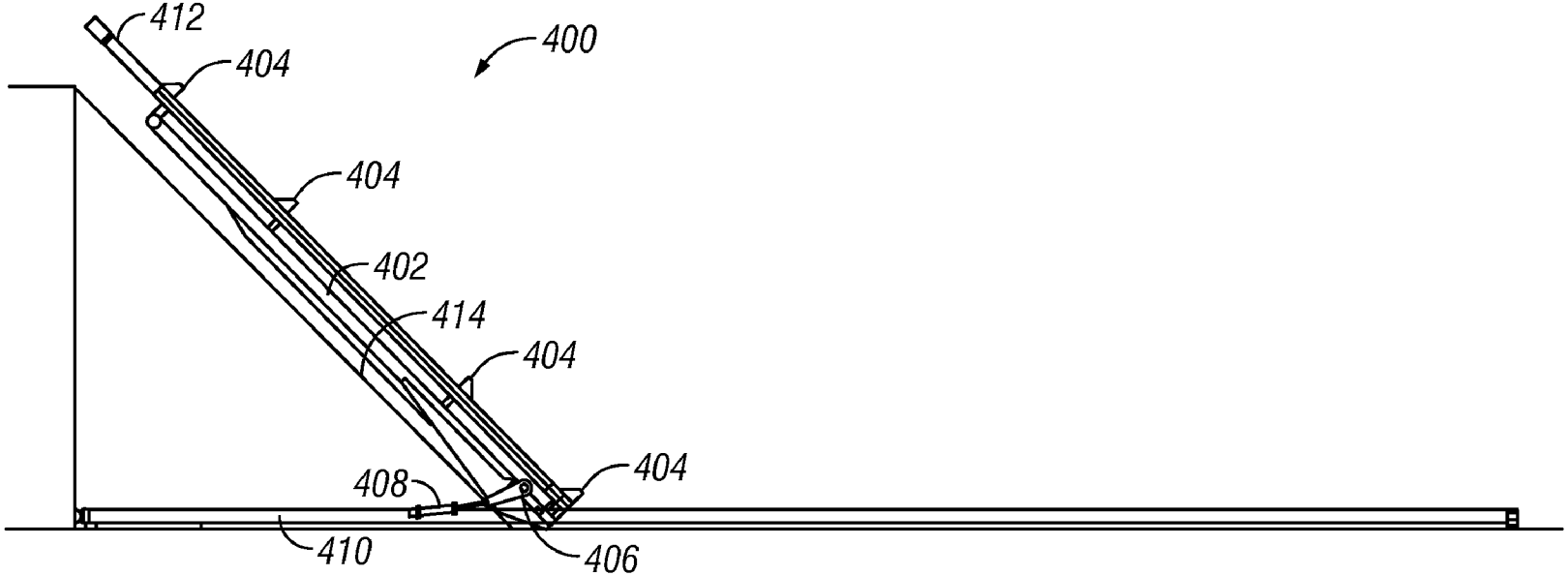

Referring to FIGS. 10-12, the erector system 400 comprises an erector frame 402, pipe guides 404, a pivot 406, an elevating cylinder 408, and a rail 410. The erector system 400 is utilized to elevate a pipe 412 from horizontal, as in FIG. 1, and move the pipe to a ramp 414 of the rig 416. The pipe 412 is received by pipe guides 404 mounted on the frame 402. The elevating cylinder 408 elevates the frame 402 to an angle so that the axis of the pipe 412 is substantially parallel to the ramp 414. The frame 402 is then moved along the rail 410 until the pipe 412 is adjacent to the ramp 414. Once on the ramp 414, the elevator 84, 138, or some other lifting mechanism can engage the pipe 412 and lift the pipe into the rig 416.

When the pipe 412 is lifted into the rig 416 from the angled ramp 414, as previously noted, it may be desirable to control the lateral movement of the lower end of the pipe 412 so that the pipe does not swing dangerously once lifted from the ramp 414. Thus, the various embodiments of a pipe guide system as disclosed herein may be attached to the mast 122, or other drill floor equipment, and operated as described herein to control and guide the pipe 412 to well center 152. In the pipe guide system 30, the rotating arms are moveable support members, and the cable coupled therebetween is an expandable guide member adapted to receive and guide the pipe. The cable may also include a roller assembly to facilitate movement and release of the expandable guide member from the pipe.

While certain embodiments of the disclosed principles have been shown and described, modifications thereof can be made by one skilled in the art without departing from the scope or teaching of this disclosure. The embodiments described herein are exemplary only and are not limiting. Accordingly, the scope of protection is not limited to the embodiments described herein, but is only limited by the claims that follow, the scope of which shall include all equivalents of the subject matter of the claims.

What is claimed is:

1. A pipe handling system comprising:

a lifting mechanism coupled to an upper end of a pipe; and a guide system operable to engage the pipe and control lateral movement of the pipe as it is moved between a storage position and a well center position, the guide system comprising:

a pair of support members including extendable end portions; and a flexible pipe guide coupled between the extendable end portions.

2. The pipe handling system of claim 1 wherein the flexible pipe guide is expandable between the extendable end portions.

3. The pipe handling system of claim 2 wherein the flexible pipe guide includes an expanded position engaging the pipe between extended positions of the end portions.

4. The pipe handling system of claim 3 wherein the flexible pipe guide includes a contracted position releasing the pipe when the end portions are fully retracted.

5. The pipe handling system of claim 1 wherein the flexible pipe guide includes a cable.

6. The pipe handling system of claim 1 wherein support ends of the support members opposite the extendable end portions are rotated about pivot points having multiple axes of rotation.

7. The pipe handling system of claim 6 wherein the support members are rotatable arms having offset axes of rotation.

8. The pipe handling system of claim 1 further comprising a rig structure to which the lifting mechanism and the guide system are coupled.

9. The pipe handling system of claim 8 further comprising:

an elevated drill floor of the rig structure;

a pipe erector operable to move a pipe from a horizontal storage position to an inclined position where an upper end of the pipe is adjacent to the elevated drill floor, wherein in the inclined position, the pipe is at an angle between horizontal and vertical and the upper end of the pipe is offset from well center; and wherein the guide system is operable to engage the pipe and control lateral movement of the pipe toward well center as the pipe is moved from being supported in the inclined position by the pipe erector to a vertical position supported by the rig, the support members extending to expand the flexible guide and engage the pipe between the inclined position and the vertical position, and the support members retracting to contract the flexible guide and release the pipe in the vertical position.

10. A pipe handling system comprising:

a guide system operable to engage a pipe and control lateral movement of the pipe as it is moved between a storage position and a well center position, the guide system comprising:

a pair of rotatable support arms having first pivot ends and second ends; and an expandable pipe guide connecting the second ends;

wherein the first pivot ends each include a pivot point having an axis of rotation, and the axes of rotation are different.

11. The pipe handling system of claim 10 wherein the pipe guide is expandable in response to rotation of the support arms about the first pivot ends.

12. The pipe handing system of claim 10 wherein the axes of rotation are angled relative to each other.

13. The pipe handling system of claim 10 wherein the axes of rotation are offset.

14. The pipe handling system of claim 10 wherein the expandable pipe guide includes a cable including a roller assembly.

15. The pipe handling system of claim 10 further comprising a drive mechanism operable to rotate the pair of arms about the pivot ends.

16. The pipe handling system of claim 10 further comprising a frame supporting the pivot ends.

17. The pipe handling system of claim 16 wherein the frame includes bend plates supporting the pivot ends at offset angles.

18. The pipe handling system of claim 17 wherein the arms include angled levers and intermediate bends.

19. A pipe handling method comprising:

supporting an upper end of a pipe with a lifting mechanism;

rotating support arms to extend a pipe guide;

expanding the pipe guide in response to rotating the support arms; and engaging the pipe with the extended and expanded pipe guide to control lateral movement of the pipe.

20. The method of claim 19 further comprising:

further rotating the support arms; and contracting the pipe guide to release the pipe.

21. The method of claim 19 further comprising moving the pipe from a storage position toward a well center position by retracting the pipe guide support arms and contracting the pipe guide between the support arms.

22. The pipe handling method of claim 19 further comprising moving the pipe from a well center position toward a storage position by extending the pipe guide support arms and expanding the pipe guide between the support arms.

23. The pipe handling method of claim 19 further comprising:

retracting and contracting the pipe guide;

aligning the pipe with a drill string supported by a drilling rig;

disengaging the pipe from the pipe guide; and engaging the pipe with the drill string.

24. A pipe handling system comprising:

a pair of support members to be coupled to a rig structure and having ends extendable from the rig structure; and an expandable pipe guide coupled between the extendable ends of the support members, wherein the pipe guide is expandable between the extendable ends of the support members to engage a pipe and control lateral movement of the pipe as it is moved between a storage position and a well center position.

* * * * *